US005629465A

United States Patent [19]

Hisham et al.

[11] Patent Number: 5,629,465

[45] Date of Patent: May 13, 1997

[54] MANUFACTURING OLEFINS FROM GAS OIL

[75] Inventors: Mohamed W. M. Hisham; Mohan S. Saran, both of Grand Island, N.Y.

[73] Assignee: Occidental Chemical Corporation, Niagara Falls, N.Y.

[21] Appl. No.: 440,612

[22] Filed: May 15, 1995

[51] Int. Cl.[6] ..... C07C 4/04; C10G 55/04

[52] U.S. Cl. ..... 585/648; 585/650; 208/91; 208/92

[58] Field of Search ..... 585/648, 650; 208/91, 92

[56] References Cited

U.S. PATENT DOCUMENTS

| | | | |
|---|---|---|---|
| 3,051,646 | 8/1962 | Brooke et al. | 208/250 |
| 4,634,516 | 1/1987 | Haskell et al. | 208/91 |
| 5,114,562 | 5/1992 | Haun et al. | 208/89 |

OTHER PUBLICATIONS

Hack's Chemical Dictionary, 3rd. Edition, Copyright 1944. Editor: Julius Grant, p. 852 1944.

Abstract, Article titled "Coprocessing of Coal/Heavy Oil Using Syngas, Effect of Catalyst Support,", Makoto Akiyoshi, in Sekitan Kagaku Kaigi Happyo Ronbunshu, (1992), 29th, 209–12. No Month on Abstract.

Abstract, Article titled "Identification of Nonhydrocarbon Aromatic Compounds In the Gas Oil Fraction of Kuwait Petroleum,", Mousa J. Ijam et al., in Sep. Sci. Technology (1992), 27(1), 73–86. No Month on Abstract.

Abstract, Article titled "Identification and Quantification of Nitrogen and Sulfur Compounds In Catalytically Cracked Heavy Gas Oils By Isobutane/CI GC/MS and GC Using Selective Detectors," in J. Chromatogr. Sci. (1988), 26(5), 236–40, by Ismet Dzidic et al. No Month on Abstract.

Abstract, Article titled "Capillary Column Gas Chromatographic Analysis of Diesel Fuels Using Simultaneous Parallel Triple Detection," P. T. Williams et al., in Proc. Int. Symp. Capillary Chromatogr., 6th (1985), 688–701. (No Month).

Abstract, Article titled "Application of A Flame Photometric Detector To The Gas Chromatographic Measurement of Sulfur Compounds In Hydrocarbon Fractions," A. R. Baig, in Chromatographia, (1982), 16, 297–300. (No Month).

Abstract, Article titled "Application of Mass–Spectrometric and Chromatographic Techniques For The Analysis of Sulfur Compounds In Petroleum Fractions," Jiri Mostecky, in Sb. Vys. Sk. Chem.–Technol. Praze, Technol. Paliv (1982), D46, 269–92. (No Month).

Abstract, Article titled "Hydrodesulfurization Reactivities of Narrow–Cut Fractions In A Gas Oil," X. Ma et al., in Ind. Eng. Chem. Res., vol. 34, pp. 748–754 (1995). (No Month).

*Primary Examiner*—Glenn A. Caldarola
*Assistant Examiner*—Nadine Preisch
*Attorney, Agent, or Firm*—Richard D. Fuerle; Arthur S. Cookfair

[57] ABSTRACT

Disclosed is a method of selecting a gas oil feedstock for use in manufacturing olefins. The feedstock is analyzed for the presence of benzothiophenes and is used to manufacture olefins only if it contains less than 50 ppm (as sulfur) of benzothiophenes. The concentration of benzothiophenes can be reduced by distilling the feedstock and removing the fraction of the feedstock that boils between about 45° and about 60° C. under reduced pressure of about 0.05 to about 0.1 mmHg. The concentration of benzothiophenes can also be reduced by passing the feedstock through a benzothiophene adsorber such as activated alumina or activated carbon.

13 Claims, No Drawings

MANUFACTURING OLEFINS FROM GAS OIL

BACKGROUND OF THE INVENTION

This invention relates to the manufacture of $C_2$ and $C_3$ olefins from gas oil in a higher yield than was previously attained. In particular, it relates to manufacturing olefins from gas oil feedstocks that contain low concentrations of benzothiophenes, either because the feedstock has been selected for low benzothiophenes concentration or because benzothiophenes have been removed from the feedstock.

Gas oil is a crude oil distillation cut primarily consisting of a mixture of $C_6$ to $C_{16}$ hydrocarbons. Olefins can be manufactured from gas oil by cracking these hydrocarbons into smaller units. Cracking is accomplished by pyrolysis—heating the gas oil at high temperatures in the presence of steam and the absence of oxygen. Cracking produces a mixture of olefins of different chain lengths. Ethylene and propylene are the olefins which have the greatest commercial value.

SUMMARY OF THE INVENTION

We have discovered that certain components of some gas oils act as inhibitors in manufacturing olefins and reduce the yield of the most desirable olefins, ethylene and propylene. These inhibitors are benzothiophine and substituted benzothiophenes, particularly benzothiophenes that are unsubstituted in the three position.

As a result of this discovery, we have found that the yield of ethylene and propylene can be enhanced either by using gas oil that contains a low concentration of benzothiophenes or by reducing the concentration of benzothiophenes in the gas oil. The value of the increased yield of ethylene and propylene is very significant, worth tens of millions of dollars per year.

DESCRIPTION OF THE PREFERRED EMBODIMENTS

Gas oil is a cut from the distillation of crude oil that has a boiling point in the range of about 150° to about 350° C. The composition of gas oil varies with the location of the crude oil from which it was cut. Gas oil is principally a mixture of $C_6$ to $C_{16}$ hydrocarbons (e.g., paraffins, naphthenes, aromatics), but it also contains minor amounts of various other organic compounds. A typical gas oil feedstock may contain about 200 to about 5000 ppm (as sulfur) of various benzothiophenes. A benzothiophene (for the purpose of this invention) is a compound having a benzothiophene ring system

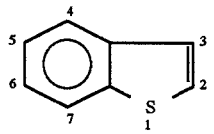

where the seven positions indicated can be substituted with alkyl from $C_1$ to $C_4$ or alkylene from $C_2$ to $C_4$. We have found that the presence of benzothiophenes in gas oil inhibits the production of $C_2$ and $C_3$ olefins, and that this is especially true when the 3-position of the benzothiophene ring is not substituted.

Thus, the essence of this invention is, in making olefins from gas oil, to use gas oil that is substantially free of benzothiophenes, especially benzothiophene and benzothiophenes that are unsubstituted in the 3-position. The feedstock used should contain less than 50 ppm (as sulfur) of benzothiophenes, and preferably should contain less than 10 ppm (as sulfur) of benzothiophenes.

Benzothiophenes-free gas oil feedstock can be obtained by selecting feedstock that already contains low concentrations of benzothiophenes. This can be accomplished by testing or analyzing the feedstock to determine the benzothiophene concentration therein and using only those feedstocks that contain low concentrations of benzothiophenes. The analysis of the feedstock for the presence of benzothiophenes is most advantageously accomplished using gas chromatography—mass spectroscopy (GC/MS) or a gas chromatograph equipped with a sulfur chemiluminescence detector.

Benzothiophenes-free gas oil can also be obtained by removing benzothiophenes from gas oil that contains high concentrations of benzothiophenes. That is, if a feedstock contains more than 10 or 50 ppm (as sulfur) benzothiophenes, a sufficient amount of the benzothiophenes is removed from the feedstock to lower their concentration below 50 ppm, and preferably below 10 ppm. This can be accomplished by distilling the feedstock and discarding distillate that boils between 45° and 60° C. under reduced pressure of about 0.05 to about 0.1 mmHg, as distillate boiling in that range contains benzothiophenes. The discarded distillate can be used for other purposes where the presence of benzothiophenes is not important.

Removal of benzothiophenes from the feedstock can also be accomplished by passing the feedstock through an adsorbent for benzothiophenes. We have found that activated alumina and activated carbon are good adsorbents for benzothiophenes. It is surprising that these substances are effective as adsorbents for benzothiophenes because we found that many other materials commonly used as adsorbents, such as Fuller's earth, silica gel, molecular sieves, sand, nickel oxide, copper oxide, sodium hydroxide beads, and manganese dioxide, were ineffective in adsorbing benzothiophenes from gas oil. At least about 1 bed volume of absorbent should be used for every 4 volumes of gas oil. When the bed has been exhausted, it can be reactivated with air heated to about 300° to about 400° C.

Once gas oil has been obtained with a low concentration of benzothiophenes it is pyrolyzed to form olefins. Pyrolysis is accomplished by heating the gas oil, typically at about 750° to about 850° C., in the presence of steam and the absence of oxygen. This cracks the gas oil into smaller carbon chains, and especially into valuable ethylene and propylene. The use of gas oil containing low concentrations of benzothiophenes can result in as much as a 5% increase in the yield of ethylene and propylene, as the examples which follow will demonstrate.

The following examples further illustrate this invention.

EXAMPLE 1

Sulfur free gas oil was pyrolyzed in a 1-inch diameter quartz tube 12 inches long. For comparison some gas oil samples were doped with benzothiophene (BT) or dibenzothiophene (DBT). The gas oil flow rate was 0.203 g/min and the flow rate of the nitrogen diluent was 1.37 g/min. The following table gives the reaction temperature, the benzothiophenes added, and the yields of ethylene and propylene.

| Temp °C. | Additive | Amount of Additive (ppm) | Amount of Additive as S (ppm) | $C_2H_4$ (wt %) Absolute | $C_2H_4$ (wt %) Difference* | $C_3H_6$ (wt %) Absolute | $C_3H_6$ (wt %) Difference* |
|---|---|---|---|---|---|---|---|
| 775 | — | — | — | 17.8 | — | 10.9 | — |
| 775 | BT | 100 | 24 | 17.0 | −0.8 | 10.4 | −0.5 |
| 775 | BT | 500 | 119 | 16.7 | −1.1 | 10.2 | −0.7 |
| 775 | BT | 1000 | 239 | 16.2 | −1.6 | 9.9 | −1.0 |
| 775 | BT | 2000 | 478 | 15.7 | −2.1 | 9.5 | −1.4 |
| 775 | DBT | 2900 | 504 | 17.9 | 0.1 | 10.9 | 0.0 |
| 750 | — | — | — | 14.2 | — | 10.8 | — |
| 750 | BT | 2000 | 478 | 12.2 | −2.0 | 8.7 | −2.1 |
| 800 | — | — | — | 19.9 | — | 8.8 | — |
| 800 | BT | 2000 | 478 | 18.0 | −1.9 | 7.8 | −1.0 |

*With inhibitor minus without inhibitor.

The table shows that the benzothiophene reduced the yields of ethylene and propylene. The table also shows that dibenzothiophene did not reduce the yield of ethylene or propylene.

EXAMPLE 2

Example 1 was repeated using 2000 ppm (as sulfur) of 2-methyl benzothiophene (2-MBT) or 2,5-dimethyl benzothiophene (DMBT). The following table gives the results.

| | $CH_4$ (wt %) | $C_2H_4$ (wt %) | $C_3H_6$ (wt %) | $CH_4/C_3H_6$ (wt %) |
|---|---|---|---|---|
| | TEMPERATURE 775° C. | | | |
| No Additive | 6.0 | 13.4 | 8.4 | 0.71 |
| 2-MBT | 5.4 | 11.8 | 7.3 | 0.74 |
| DMBT | 4.9 | 10.8 | 6.4 | 0.71 |
| | TEMPERATURE 800° C. | | | |
| No Additive | 7.1 | 15.3 | 8.4 | 0.85 |
| 2-MBT | 6.6 | 14.2 | 7.6 | 0.87 |
| DMBT | 6.0 | 13.0 | 7.4 | 0.81 |
| | TEMPERATURE 825° C. | | | |
| No Additive | 8.9 | 18.4 | 8.8 | 1.01 |
| 2-MBT | 8.0 | 16.3 | 7.6 | 1.05 |
| DMBT | 7.2 | 15.0 | 7.6 | 0.95 |

The table shows that the benzothiophenes reduced the yield of ethylene and propylene.

EXAMPLE 3

Example 1 was repeated at 775° C. using 3-methylbenzothiophene (3-MBT). The following table gives the results:

| Product | Yield (wt %) Pure Gas Oil | Yield (wt %) 3-MBT |
|---|---|---|
| $CH_4$ | 10.5 | 10.2 |
| $C_2H_6$ | 2.0 | 2.0 |
| $C_2H_4$ | 26.4 | 26.5 |
| $C_3H_8$ | 0.3 | 0.3 |
| $C_3H_6$ | 14.2 | 13.8 |
| $C_4H_{10}$ | 0.3 | 0.3 |

-continued

| Product | Yield (wt %) Pure Gas Oil | Yield (wt %) 3-MBT |
|---|---|---|
| $C_4H_8$ | 3.2 | 3.1 |
| $C_4H_6$ | 6.2 | 6.0 |
| $C_4$'s plus other minor compounds | 36.9 | 37.8 |

The table shows that 3-MBT does not significantly reduce the yield of ethylene or propylene.

EXAMPLE 4

Gas oil was analyzed by GC/MS and was found to contain benzothiophenes. Using an Oldershaw 5 tray distillation column the gas oil was distilled under 0.05 to 0.1 mm Hg and cuts were collected at vapor temperatures of 49° C. (pot temperature=165° C.) and 57° C. (pot temperature=180° C.). Those cuts were analyzed by GC/MS and were found to contain benzothiophenes.

We claim:

1. A method of manufacturing olefins from gas oil feedstocks comprising:

(A) determining the concentration of benzothiophenes that are unsubstituted in the 3-position in a gas oil feedstock;

(B) if a feedstock contains more than 50 ppm (as S) of said benzothiophenes, reducing the concentration of said benzothiophenes to less than 50 ppm (as S); and (C) pyrolyzing said feedstock.

2. A method according to claim 1 wherein the concentration of said benzothiophenes is reduced to less than 10 ppm (as S).

3. A method according to claim 1 wherein the concentration of said benzothiophenes is reduced by passing said feedstock through activated alumina.

4. A method according to claim 1 wherein said benzothiophenes are pyrolyzed at about 750° to about 850° C.

5. A method according to claim 1 wherein the concentration of the benzothiophenes in said gas oil feedstock is determined using gas chromatography-mass spectroscopy.

6. A method according to claim 1 wherein said feedstock is analyzed using a gas chromatography equipped with a sulfur chemiluminescence detector.

7. A method of making olefins from a gas oil feedstock that initially contains more than 10 ppm (as S) of benzothiophenes that are unsubstituted in the 3-position comprising:

(A) reducing the concentration of said benzothiophenes in said gas oil feedstock, where the final concentration of said benzothiophenes is less than 50 ppm; and (B) pyrolyzing said gas oil feedstock.

8. A method according to claim 7 wherein the final concentration of said benzothiophenes is less than 10 ppm.

9. A method according to claim 7 wherein said feedstock is pyrolyzed at about 750° to about 850° C.

10. A method according to claim 7 wherein the concentration of said benzothiophenes is reduced by distilling said feedstock and removing the fraction of said feedstock that boils between about 45° and about 60° C. under reduced pressure of about 0.05 to about 0.1 mmHg.

11. A method according to claim 7 wherein the concentration of said benzothiophenes is reduced by passing said feedstock through an adsorbent for said benzothiophenes.

12. A method according to claim 11 wherein said adsorbent is activated alumina.

13. A method according to claim 11 wherein said adsorbent, when exhausted, is reactivated with air heated to about 300° to about 400° C.

* * * * *